US009517634B2

(12) United States Patent
Kobayashi et al.

(10) Patent No.: US 9,517,634 B2
(45) Date of Patent: Dec. 13, 2016

(54) PRINTING CONTROL APPARATUS AND PRINTING CONTROL METHOD

(71) Applicant: SEIKO EPSON CORPORATION, Tokyo (JP)

(72) Inventors: Takashi Kobayashi, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/631,432

(22) Filed: Feb. 25, 2015

(65) Prior Publication Data

US 2015/0258804 A1 Sep. 17, 2015

(30) Foreign Application Priority Data

Mar. 12, 2014 (JP) ..... 2014-049493

(51) Int. Cl.

| | |
|---|---|
| ***B41J 2/21*** | (2006.01) |
| ***B41J 2/205*** | (2006.01) |
| ***B41J 2/175*** | (2006.01) |
| ***B41J 29/38*** | (2006.01) |

(52) U.S. Cl.

CPC ..... *B41J 2/2054* (2013.01); *B41J 2/17566* (2013.01); *B41J 2/2132* (2013.01); *B41J 29/38* (2013.01)

(58) Field of Classification Search

CPC ..... B41J 2/2052; B41J 2/2132; B41J 2/5056; B41J 2002/17566; B41J 2002/17569; B41J 2002/17589; B41J 2/2054; B41J 2/17566; B41J 29/38

USPC ..... 347/7, 20, 23, 41

See application file for complete search history.

(56) References Cited

U.S. PATENT DOCUMENTS

| | | | | |
|---|---|---|---|---|
| 6,164,745 | A * | 12/2000 | Nagoshi | B41J 19/142 347/15 |
| 2006/0012621 | A1* | 1/2006 | Yoshida | B41J 3/54 347/9 |
| 2006/0050097 | A1* | 3/2006 | Hoshiyama | B41J 19/145 347/16 |

(Continued)

FOREIGN PATENT DOCUMENTS

| | | | | |
|---|---|---|---|---|
| JP | 3072792 | B2 * | 8/2000 | B41J 2/21 |
| JP | 2001-347650 | A * | 12/2001 | B41J 2/01 |
| JP | 2006-326939 | A | 12/2006 | |

*Primary Examiner* — Stephen Meier
*Assistant Examiner* — Sharon A Polk
(74) *Attorney, Agent, or Firm* — Global IP Counselors, LLP

(57) ABSTRACT

A printing control apparatus is configured to use a recording head where a plurality of nozzles are arranged in a row formation with a predetermined pitch, and configured to perform interlace printing such that a resolution is equal to or more than a resolution that is based on the pitch when printing is performed due to ink droplets being discharged from each of the nozzles. The printing control apparatus includes a dischargeable amount acquiring section configured to determine a dischargeable amount per unit of time according to a remaining amount of ink in an ink cartridge, and a split printing control section configured to split a predetermined region in one band an odd number of times according to the dischargeable amount per unit of time, and configured to carry out interlace printing in each of split regions on an outward path and a return path.

8 Claims, 11 Drawing Sheets

(56) References Cited

U.S. PATENT DOCUMENTS

2006/0146082 A1* 7/2006 Nunokawa ..... B41J 2/2103
347/15
2008/0278530 A1* 11/2008 Tanaka ..... B41J 2/17566
347/14

* cited by examiner

PRINTING CONTROL APPARATUS AND PRINTING CONTROL METHOD

CROSS-REFERENCE TO RELATED APPLICATIONS

This application claims priority to Japanese Patent Application No. 2014-049493 filed on Mar. 12, 2014. The entire disclosure of Japanese Patent Application No. 2014-049493 is hereby incorporated herein by reference.

BACKGROUND

1. Technical Field

The present invention relates to a printing control apparatus and a printing control method where split printing is carried out according to a dischargeable amount per unit of time.

2. Related Art

There is disclosed a technique for split printing where printing is carried out by a plurality of times of scanning (multipass scanning) irrespective of printing being theoretically possible in one pass. As disclosed in JP-A-2006-326939 (PTL 1), an amount of ink flow is reduced by increasing the number of passes in multipass scanning when the remaining amount of ink is less than a threshold.

SUMMARY

As disclosed in PTL 1, there is a possibility that the normal number of passes in multipass scanning will increase when the remaining amount of ink is low and that printing time for multipass printing with multipass scanning will increase more than necessary. In addition, a phenomenon such as Bi-d deviation occurs depending on the manner of splitting.

The present invention provides a printing control apparatus and a printing control method where a phenomenon such as Bi-d deviation (bi-directional printing deviation) does not occur even when split printing is carried out according to a dischargeable amount per unit of time.

The present invention is a printing control apparatus configured to use a recording head where a plurality of nozzles are arranged in a row formation with a predetermined pitch, and configured to perform interlace printing on an outward path and a return path such that a resolution is equal to or more than a resolution that is based on the pitch when printing is performed due to supplying of ink being received from an ink cartridge and ink droplets being discharged from each of the nozzles. The printing control apparatus includes a dischargeable amount acquiring section configured to determine a dischargeable amount per unit of time according to a remaining amount of ink in the ink cartridge, and a split printing control section configured to split a predetermined region in one band an odd number of times according to the dischargeable amount per unit of time, and configured to carry out interlace printing in each of the split regions on the outward path and the return path.

In this configuration, the recording head, where the plurality of nozzles are arranged in a row formation with the predetermined pitch, is used and interface printing is performed on the outward path and the return path such that the resolution is equal to or more than the resolution that is based on the pitch. Printing is performed due to supplying of ink being performed from the ink cartridge to each of the nozzles and ink droplets being discharged from each of the nozzles. In addition, the dischargeable amount acquiring section determines the dischargeable amount per unit of time according to the remaining amount of ink in the ink cartridge, and the split printing control section splits the predetermined region in one band an odd number of times according to the dischargeable amount per unit of time and performs interlace printing in each of the split regions on the outward path and the return path.

Ink droplets are discharged between the nozzles by printing on the outward path and the return path in theory in a case where interlace printing is performed in each of the split regions on the outward path and the return path. However, printing is carried out on the outward path or the return path in each of the split regions when each of the split regions is split an even number of times. It is known that deviations are generated at landing positions on the outward path and the return path, and deviations stand out in a case where the regions which are printed only on the outward path and the regions which are printed only on the return path are alternately lined up with each other.

In contrast to this, deviations are prevented from standing out due to the regions which are printed only on the outward path and the regions which are printed only on the return path alternating with each other as if split an even number of times since printing is carried out while each of the split regions is filled in on the outward path and the return path when splitting the regions an odd number of times.

As one aspect of the present invention, the split printing control section may be configured to determine a number of splits according to the remaining amount of ink in the ink cartridge. The remaining amount of ink and the dischargeable amount per unit of time are related through the ink cartridge. In this case, it is not possible to perform printing when the dischargeable amount per unit of time, which corresponds to the remaining amount of ink during printing, exceeds the amount which is necessary for discharge even for printing carried out in one pass. Alternatively, it is not possible to use the ink cartridge in a state where the ink is not used up even if printing is possible. In order to prevent this, split printing is carried out so as to reduce the amount which is necessary for discharge per unit of time. The number of splits is determined according to the remaining amount of ink in the ink cartridge.

As one aspect of the present invention, the split printing control section may be configured to split the predetermined region in one band the odd number of times according to a limit on power consumption, and be configured to carry out the interlace printing in each of the split regions on the outward path and the return path.

Power consumption is related to the number of nozzles because it is necessary to supply power to each of the nozzles in ink droplet discharge. It is possible to reduce the number of nozzles which are used and to reduce power consumption by carrying out split printing in a case where the limit on power consumption is exceeded when all the nozzles are used in one band. For this reason, the predetermined region in one band is split an odd number of times according to the limit on power consumption and interlace printing is carried out in each of the split regions on the outward path and the return path.

As one aspect of the present invention, the split printing control section may be configured to split the predetermined region in one band the odd number of times according to a limit on ink duty for a printing medium, and be configured to carry out the interlace printing in each of the split regions on the outward path and the return path.

It is known that there is a limit on ink duty where absorption is possible according to the printing medium. The limit on ink duty is described using various expressions but indicates a phenomenon where there is a problem such as the printing medium being warped or there being bleeding due to a large amount of ink being absorbed per unit of time. For this reason, it is necessary that the ink duty of the printing medium is not exceeded during printing. By performing split printing even in this case, it is possible to reduce the amount of ink which is discharged per one pass and to continue printing by securing a period of time for drying. For this reason, the predetermined region in one band is split an odd number of times according to the limit on ink duty for the printing medium and interlace printing is carried out in each of the split regions on the outward path and the return path.

As one aspect of the present invention, the split printing control section may be configured not to limit a number of times of splitting to the odd number of times in a case where ink of a target for printing is only a color with a predetermined brightness.

It is often the case that it is not possible for deviations to be visible even when Bi-d deviations are generated in a case where, for example, the ink is a bright color such as yellow. If the number of times of splitting is large, the number of passes increases as a result and the period of time for printing is longer due to this. For this reason, it is possible to expect shortening of the period of time for printing irrespective of whether the number of splits is an even number in a case where visibility of deviations is not a problem.

The technical concept according to the present invention is not limited to being realized only as an aspect of a printing control apparatus, and it is possible for this technical concept to be comprehended as, for example, an invention of a printing control method which has process steps which are executed by the printing control apparatus described above, an invention of a program where processes which are realized using the printing control apparatus described above are executed using hardware (a computer), or the like. In addition, the printing control apparatus may be realized by a single apparatus, may be realized as a system which consists of a plurality of apparatuses, or may be built into a certain product (for example, a printing apparatus).

According to the present invention, it is possible to provide a printing control apparatus and a printing control method where a phenomenon such as Bi-d deviation (bi-directional deviation) does not occur even when split printing is carried out according to a dischargeable amount per unit of time.

BRIEF DESCRIPTION OF THE DRAWINGS

Referring now to the attached drawings which form a part of this original disclosure.

DETAILED DESCRIPTION OF EMBODIMENTS

An embodiment of the present invention will be described below based on the diagrams.

(1) Outline Explanation of Apparatus Configuration

Figure 1:
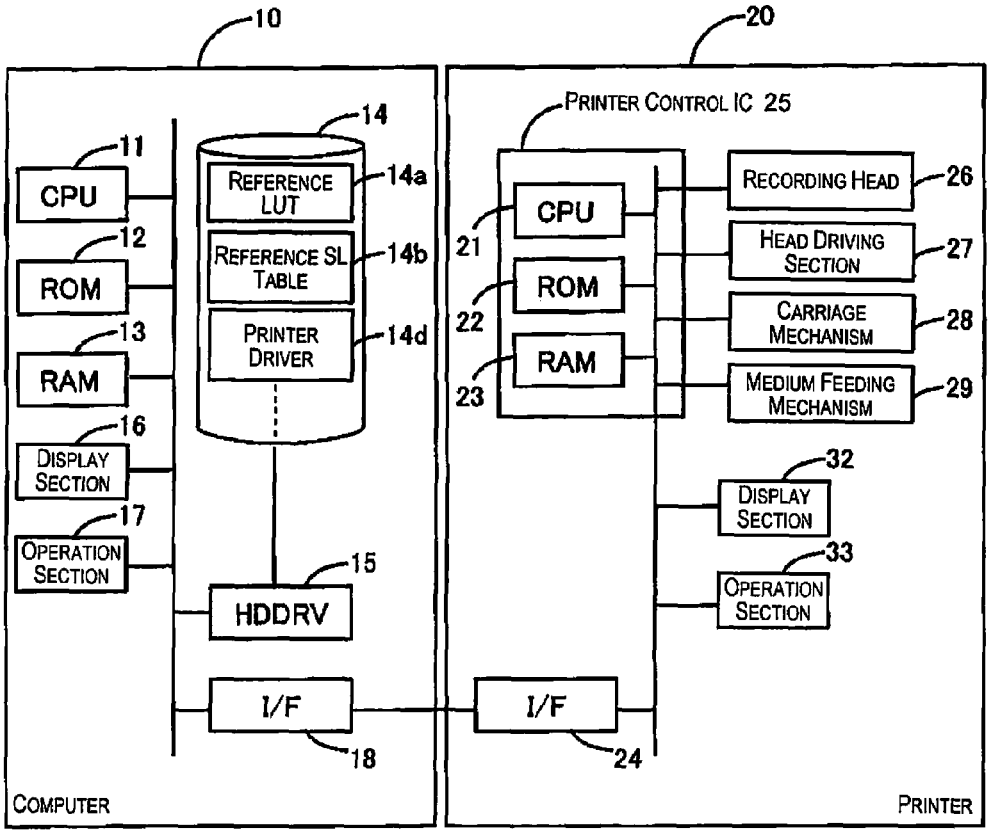
FIG. 1 is a block diagram illustrating a printing system where a printing control apparatus of the present invention is applied.

FIG. 1 illustrates a printing control apparatus according to an embodiment of the present invention using a block diagram.

The present system has, for example, a computer 10 and a printer 20. The computer 10 and/or the printer 20 are equivalent to an example of the printing control apparatus of the present invention. The printing control apparatus is the agent in executing a printing control method. In the computer 10, a CPU 11, which is the center for computation processing, controls the entirety of the computer 10 via a system bus. The bus is connected to a ROM 12, a RAM 13, and various types of interfaces (such as an I/F 18) and is also connected to a hard disk (HD) 14, which is a storage means, via a hard disk drive (HDDRV) 15. An operating system, an application program, a printer driver 14*d*, and the like are stored on the HD 14, and these are appropriately read out from the RAM 13 and executed using the CPU 11.

In addition, a reference LUT 14*a* which is a color conversion look up table (LUT) where color information in a predetermined output color system is associated with a plurality of grid points in a predetermined input color system, a reference SL table 14*b* which is a dot allocation table where gradation data which represents amounts of ink is converted into gradation data which represents amounts for forming a plurality of types of dots where the amounts of ink differ, and the like are stored on the HD 14. The printer driver 14*d*, the LUT, and table will be described later. Furthermore, the computer 10 is provided with a display section 16 which is configured using, for example, a liquid crystal display, an operation section 17 which is configured using, for example, a keyboard, a mouse, a touch pad, a touch panel, and the like.

The printer 20 is an example of a printing apparatus which is controlled by the computer 10. It is obvious that the printer 20 may be an apparatus which is able to realize printing processing by functioning autonomously without relying on controlling by the computer 10. In the printer 20, an I/F 24 is connected to an I/F 18 on the computer 10 side such that it is possible to communicate by wire or wirelessly, and a printer control IC 25 or the like is connected via a system bus. In the printer control IC 25, a CPU 21 appropriately reads out software (firmware) which is stored in a ROM 22 or the like from an RAM 23 and executes predetermined controlling. The printer control IC 25 is an IC which executes controlling mainly for printing processing and controls each section by being connected to each section of a recording head 26, a head driving section 27, a carriage mechanism 28, and a medium feeding mechanism 29. The recording head 26 will be described later.

The carriage mechanism 28 is a driving apparatus which is controlled by the printer control IC 25 and moves a carriage, which is not shown in the drawings, back and forth along a guide rail, which is not shown in the drawings, which is provided in the printer 20. The recording head 26 is mounted in the carriage and the recording head 26 discharges dots while being moved back and forth along the guide rail (main scanning). The medium feeding mechanism 29 transports a printing medium in the transport direction using a roller or the like, which is not shown in the diagrams, due to being controlled by the printer control IC 25. In addition, the printer 20 is provided with a display section 32 which is configured using, for example, a liquid crystal display and an operation section 33 which is configured using, for example, a button, a touch panel, and the like. Here, not just a device using an ink jet system but a device using a thermal system may also be adopted as the printer 20.

(2) Explanation of Recording Head

The recording head 26 receives a supply of each type of ink (for example, cyan (C) ink, magenta (M) ink, yellow (Y) ink, black (K) ink, light cyan (Lc) ink, and light magenta (Lm) ink) from ink cartridges with each type of the ink and forms an image on the printing medium by ejecting (discharging) ink droplets (dots) from a plurality of nozzles which are provided to correspond to each type of ink. The printer control IC 25 outputs applied voltage data, which corresponds to raster data which expresses an image which is a target for printing, with regard to the head driving section 27. The head driving section 27 generates and outputs an applied voltage patterns (driving waveforms) for piezoelectric elements, which are formed so as to correspond to each of the nozzles in the recording head 26, from the applied voltage data and discharges dots of each type of ink from each of the nozzles in the recording head 26. In the present embodiment, it is possible for the recording head 26 to discharge a plurality of types of dots, where the amount of ink per dot is different, from each of the nozzles. As an example, each of the nozzles discharges two types of dots where the amount of ink is different, and dots where the amount of ink is large are referred to as large dots and dots where the amount of ink is small are referred to as small dots. Printing, where a plurality of types of dots where the amount of ink is different are discharged in this manner, is referred to as multi-dot printing, but multi-dot printing is not necessarily essential to the present applied example.

Figure 2:
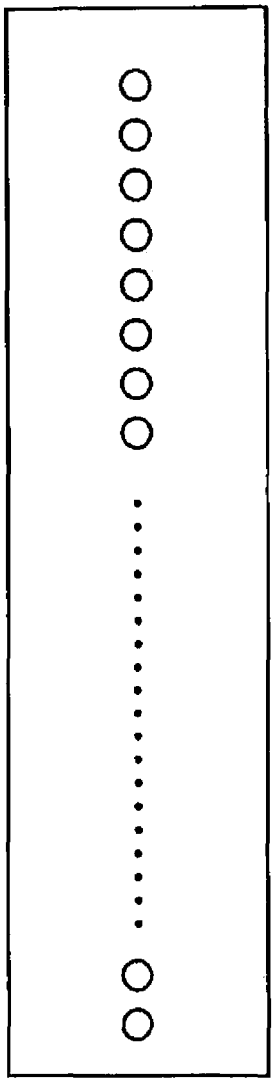
FIG. 2 is a bottom surface diagram illustrating nozzles in a row formation which are formed on a recording head.
Figure 3:
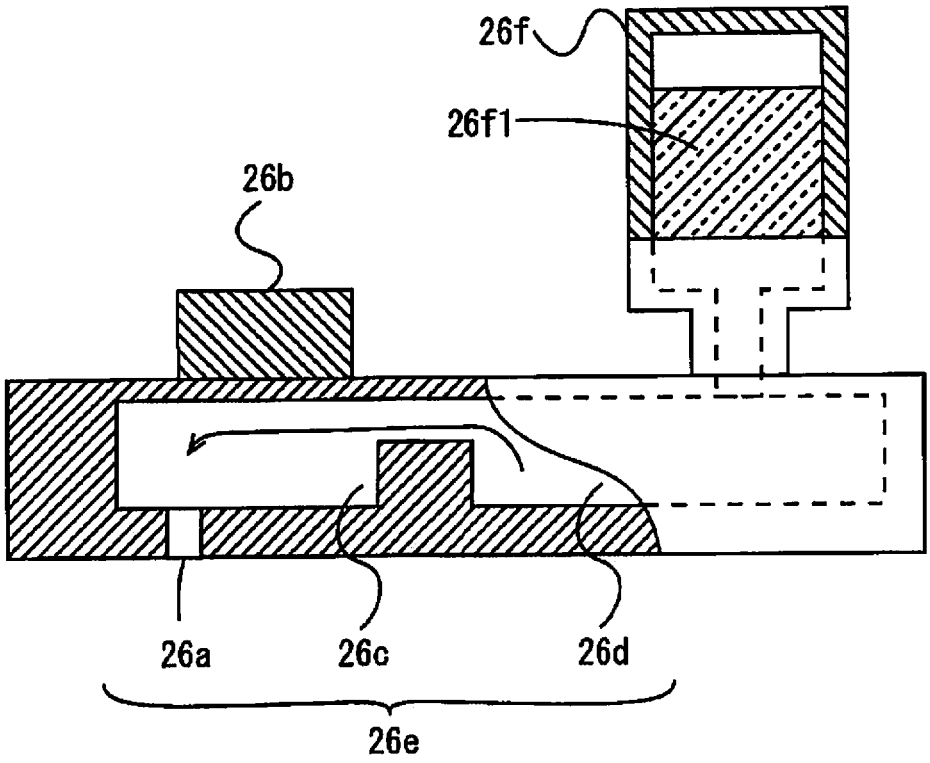
FIG. 3 is a schematic diagram which is a partial cross section of a recording head and an ink cartridge.

FIG. 2 illustrates nozzles in a row formation which are formed on the recording head using a bottom surface diagram, and FIG. 3 is a schematic diagram which is a partial cross section of the recording head and the ink cartridge.

Multiple nozzles 26*a* are formed on a bottom surface of the recording head 26 so as to be arranged at certain intervals (pitch) in one row. Here, the nozzles 26*a* may be in two rows instead of one row and may have a zig-zag shape instead of a straight line shape. In the recording head 26, an actuator 26*b* is arranged in each one of the nozzles 26*a*. In addition to the nozzle 26*a* which is a discharge opening, a reservoir 26*d* which is linked with an ink cartridge 26*f* is provided in a pressure chamber 26*c* which has a predetermined capacity. A path which reaches from the ink cartridge 26*f* to the nozzle 26*a* configures an ink flow path 26*e*. A sponge 26*f*1 is inserted into the ink cartridge 26*f* and liquid ink is absorbed and held. Here, it is possible for a plurality of types of materials to be used for the inner section of the sponge 26*f*1. The actuator 26*b* is formed using a piezoelectric element and ink droplets are discharged due to the capacity of the pressure chamber 26*c* being changed by the applied voltage pattern being individually applied.

(Remaining Amount of Ink and Duty Limit)

Figure 4:
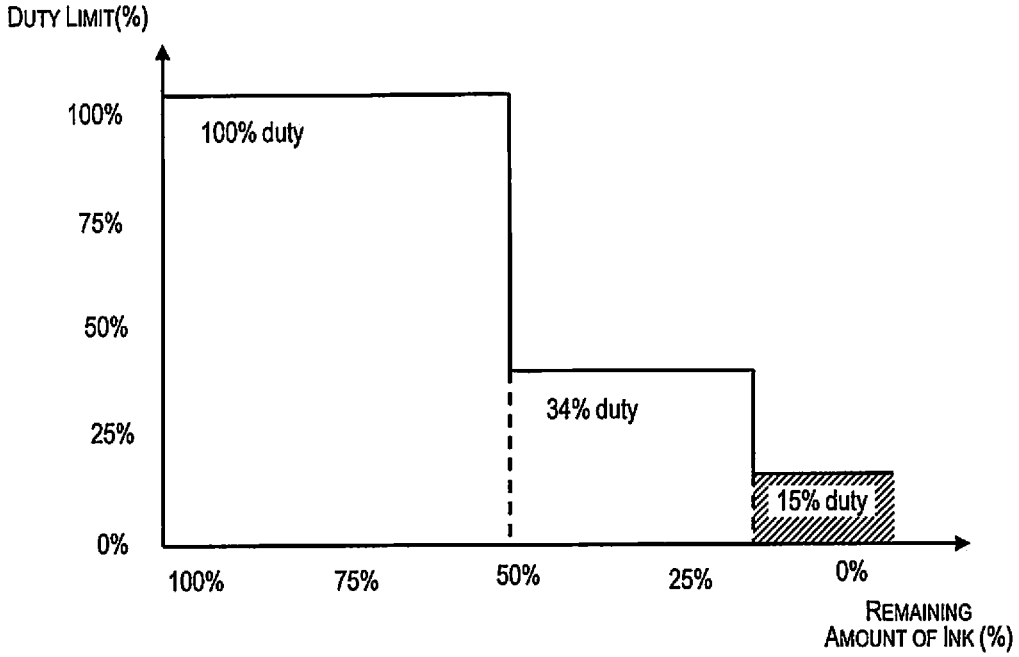
FIG. 4 is a diagram illustrating a relationship between the remaining amount of ink and a duty limit.

FIG. 4 illustrates a relationship between the remaining amount of ink and the duty limit using a graph. In FIG. 4, the remaining amount of ink is expressed on the horizontal axis and the duty limit is expressed on the vertical axis. The percentage value on the horizontal axis is 100% in a state where liquid ink is filled into the ink cartridge 26*f* so that the ink cartridge 26*f* is full. The percentage value on the vertical axis is 100% for the amount of discharge which is necessary when the recording head 26 discharges ink droplets from all of the nozzles 26*a* and how much ink is able to be supplied is represented as the dischargeable amount per unit of time or the duty limit. In other words, printing is not performed where the dischargeable amount per unit of time (the duty limit) is exceeded.

Sponge or foam is sealed in the ink cartridge 26*f* and the liquid ink is held by being impregnated into the sponge or foam. While there is merit in using the sponge, the limit for the amount of ink flow per unit of time is higher due to the sponge. Even in a case where there is the sponge, the maximum amount of ink which the recording head 26 is able to discharge per unit of time reaches 100% in a case where the remaining amount of ink is 50% or more. That is, the duty limit is 100% (where the limit is not actually reached). However, the duty limit is 34% when the remaining amount of ink drops below 50% and only 34% of the amount of ink which is necessary is able to be supplied during full usage. In addition, the duty limit is 15% when the remaining amount of ink drops below 12.5%, and only 15% of the amount of ink which is necessary is able to be supplied during full usage.

Printing of an amount which exceeds the duty limit is possible for a short period of time, but when using the ink in this manner, the amount of ink which is able to pass through the sponge is exceeded and a condition where ink runs out is apparent with regard to the ink which remains in the ink cartridge 26*f*.

(Duty Limit and Split Printing)

Figure 5A:
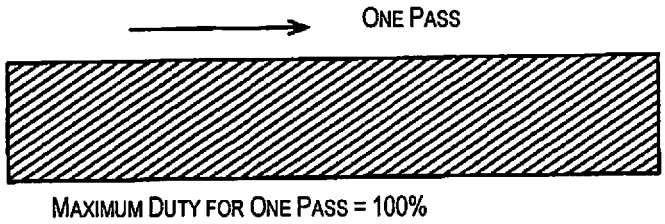
FIGS. 5A and 5B are diagrams illustrating a duty limit and concept of split printing.
Figure 5A:
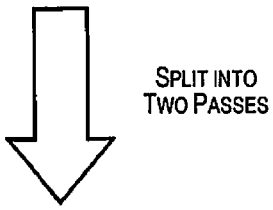
Figure 5B:
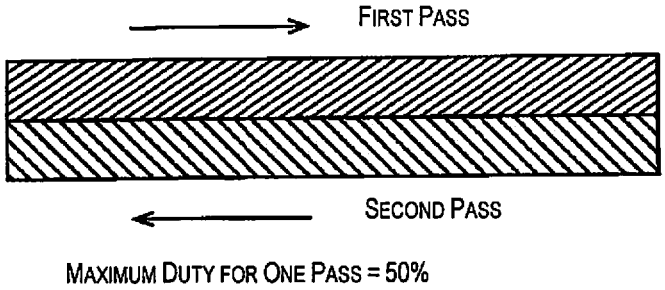

FIGS. 5A and 5B illustrate the duty limit and a concept of split printing using diagrams.

It is not possible to perform printing in full in a state where there is the duty limit, that is, a state where the duty limit is less than 100%. For this reason, printing on a region which is half of one band using only half of the nozzles 26*a* out of all of the nozzles 26*a* in a first pass which is on the outward path and printing on the region which is the remaining half of one band using only the remaining half of the nozzles 26*a* in a second pass which is on the return path as shown in FIG. 5B is used instead of printing in one pass where all nozzles 26*a* of the recording head 26 are used as is the original manner as shown in FIG. 5A. Printing controlling in this manner is referred to as split printing or pass division.

The number of splits for split printing depends on the duty limit. The number of splits may be determined with an assumption that printing in full is based simply on the duty limit. For example, the number of splits is two if the duty limit is 99% to 50%, and the number of splits is three if the duty limit is 49% to 34%. In addition, the number of splits may be determined in consideration of the amount of discharge which is necessary for each one band.

(Interlace Printing and Split Printing)

Figure 6A:
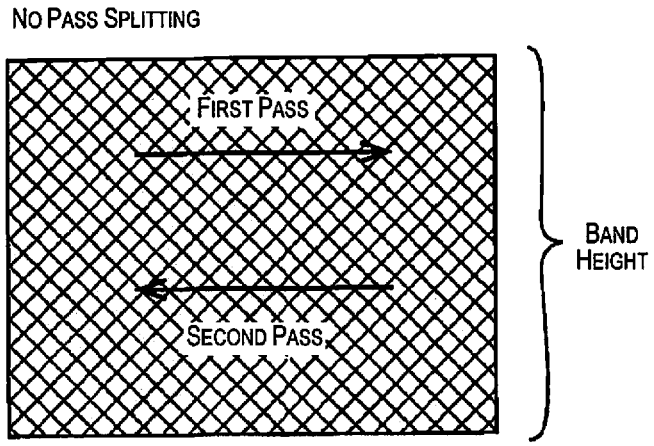
FIGS. 6A to 6C are diagrams illustrating an explanation for when interface printing is carried out with split printing.
Figure 6B:
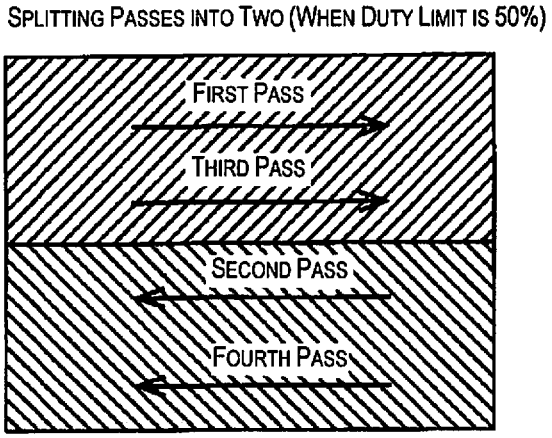
Figure 6C:
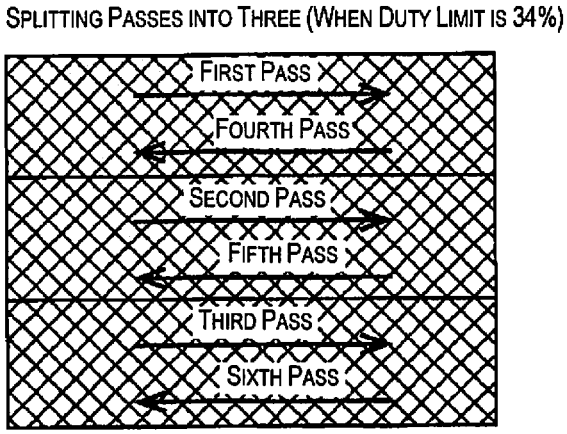

FIGS. 6A to 6C illustrate an explanation where interface printing is carried out with split printing using diagrams.

Interlace printing in the present invention is where the recording head 26, where the plurality of nozzles 26*a* are arranged in a row formation at a predetermined pitch, is used and printing is alternately performed on the outward path and the return path such that the resolution is equal to or more than the resolution which is based on the pitch when printing is performed due to supplying of ink being received from the ink cartridge 26*f* and ink droplets being discharged from each of the nozzles 26*a*. Here, the resolution is double the resolution which is based on the physical pitch between the nozzles 26*a* since the ink droplets for printing on the return path are positioned between the ink droplets which are printed on the outward path when the printing medium is sent by half of a pitch after printing on the outward path. The resolution is double in this example, but it is possible to obtain a resolution which is triple or more by increasing the number of passes.

In the interlace printing in FIG. 6A where split printing is not carried out, printing is carried out in regions with the height of one band (strictly, where half of a nozzle pitch is added) on the outward path (with the intention of an outward path part) and on the return path (with the intention of a return path part). On the return path, printing is carried out by sending the printing medium by half of a pitch such that dots are applied between the nozzles 26*a* which print on the outward path.

Split printing is possible even in the case of interlace printing, printing is carried out in the first pass which is over the outward path with the intention of the outward path part at the region which is the upper half part of the one band using only the nozzles 26*a* which are in the upper half part out of all of the nozzles 26*a*, printing is performed in the second pass which is over the return path at the region which is the lower half part which is the remainder of the one band with the intention of the outward path part using only the remaining nozzles 26*a* which are in the lower half part out of all of the nozzles 26*a*, and the printing medium is sent by half of a pitch as shown in FIG. 6B. Next, interlace printing is performed with the intention of the return path parts in a third pass and a fourth pass. Even in this case, interlace printing is performed in the third pass which is over the outward path at the region at the upper half part of the initial one band and printing is performed in the fourth pass which is over the return path at the region at the lower half part which is the remainder of the one band.

The ordering is as above (FIG. 6B) due to there being a restriction in that it is necessary for the printing medium to be sent by half of a pitch once printing on the outward path part is completed in interlace printing. In this case, printing is carried out on the outward path only in the upper half part of one band part and printing is carried out on the return path only in the lower half part of one band part.

On the other hand, in a case where the number of splits is three times, the printing medium is sent by half of a pitch after printing at the upper third on the outward path, the middle third on the return path, and the lower third on the outward path and interlace printing is carried out at each of the upper third on the return path, the middle third on the outward path, and the lower third on the return path as shown in FIG. 6C. As a result, interlace printing is carried out on the outward path and on the return path on all of the upper, middle, and lower regions.

That is, in circumstances where it is necessary to carry out split printing when carrying out interlace printing, printing is performed only on the outward path or only on the return path in each of the regions when splitting is carried out an even number of times, but it is understood that it is possible to perform interlace printing on the outward path and on the return path in all of the regions when splitting is carried out an odd number of times.

(Explanation of Printing Control)

Figure 7:
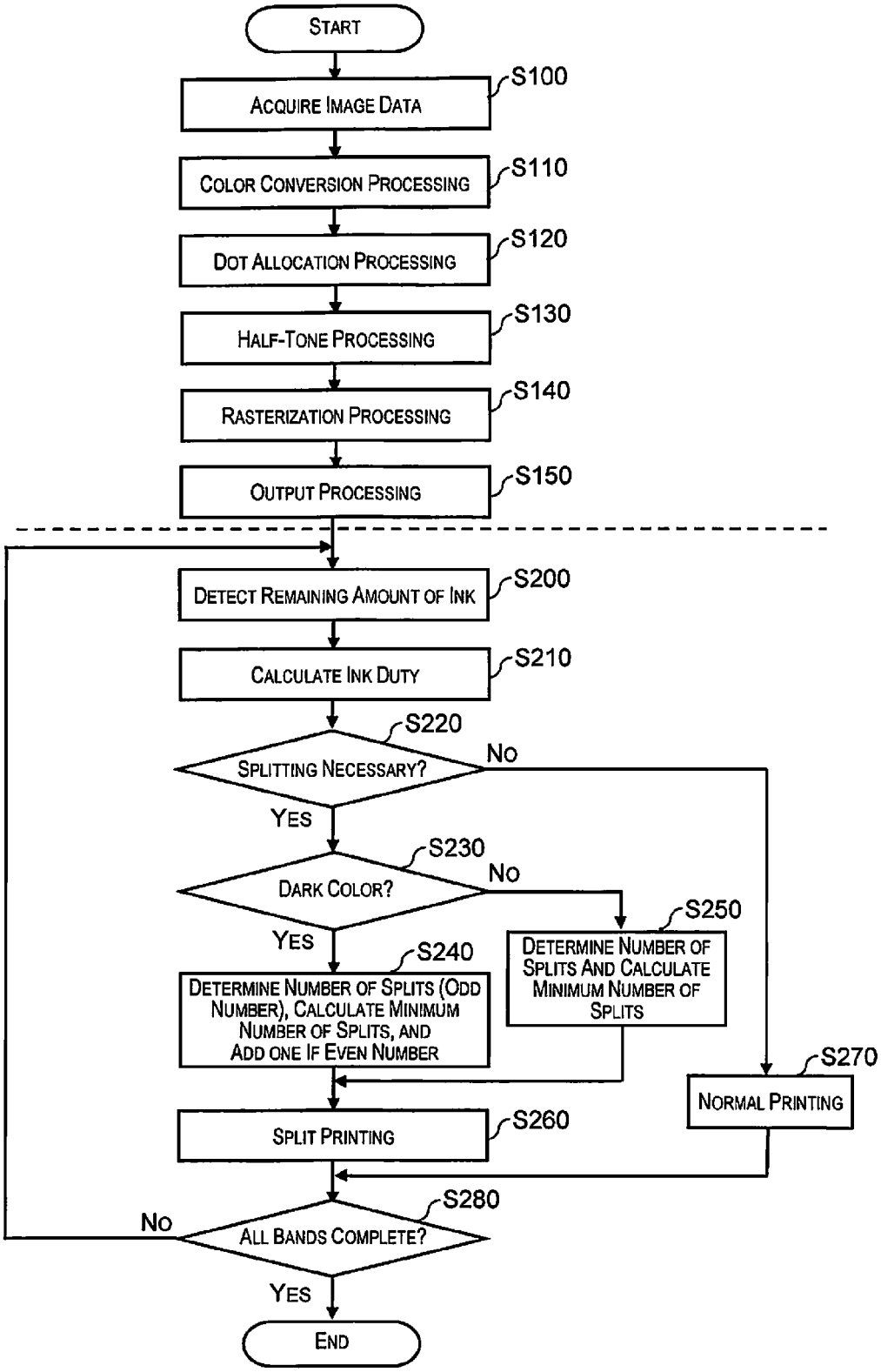
FIG. 7 is a flow chart illustrating printing control which is executed by a printing control apparatus.

FIG. 7 illustrates printing control which is executed by the printing control apparatus using a flow chart.

In step S100, the CPU 11 reads out and acquires image data or the like, which is selected by a user as the target for printing, from a predetermined memory region such as the HD 14. It is possible for a user to arbitrarily select the image data which is the target for printing by operating the operation section 17 while a predetermined UI screen, which is displayed on the display section 16, is visible. Here, it is possible for the CPU 11 to appropriately execute resolution conversion processing, image quality correction processing, and the like with regard to the image data.

In step S110, the CPU 11 carries out color conversion on the image data which is the target for printing with reference to a color conversion LUT. As a result, the image data, which has a setting for an amount of CMYKLcLm ink, is generated for each pixel. In step S120, the CPU 11 converts (carries out dot allocation processing on) each amount of ink (gradation value), which configures the settings for the amounts of ink for each pixel in the image data, to the amount for forming for small and large dots (gradation values) with reference to the dot allocation table.

In step S130, the CPU 11 executes so-called half-tone processing with the image data after dot allocation processing as the target. In the half-tone processing, a well-known method such as a dither method or an error diffusion method is used, and half-tone data, where at least one out of non-discharge of dots, small dot discharge, or large dot discharge is specified, is generated for each pixel which configures the image data and each type of ink. Here, multi-dot printing is not essential. In step S140, the CPU 11 carries out predetermined rasterization processing with regard to half-tone data and generates raster data for each type of ink where data is sorted in the order in which the recording head 26 discharges ink. In step S150, the CPU 11 outputs a printing command, which includes raster data, to the printer 20 via the IN 18. The printer 20 implements the processing of step S200 and beyond after the processing as above on the computer 10 side is complete.

In step S200, the CPU 21 on the printer side detects the remaining amount of ink. Normally, the printer 20 counts the number of shots (the number of times (and the size if necessary) with which ink droplets are discharged) since replacing of the ink cartridge 26*f* and manages the remaining amount of ink by calculating the amount of ink which is used from the number of shots. For this reason, it is sufficient if the processing, where the remaining amount of ink is detected, is simply read out from a separate non-volatile memory region in step S200. Here, if a remaining amount sensor is provided in the ink cartridge 26*f*, it is sufficient if a detection value from the remaining amount sensor is used as the remaining amount of ink. A correspondence relationship between the remaining amount of ink and the duty limit (the dischargeable amount per unit of time) is determined in advance and is stored in a table or the like. Accordingly, the duty limit is also understood when the remaining amount of ink is determined. Accordingly, the processing in step S200 configures a dischargeable amount acquiring means (step).

Next, in step S210, the CPU 21 computes the ink duty (IkD). Here, the ink duty represents the amount of ink discharge which is necessary for so-called printing of one band by referencing the raster data. The ink duty is the amount of ink discharge which is necessary for one band part of interlace printing on the outward path and the return path where all of the nozzles 26*a* of the recording head 26 are used based on the raster data. The ink duty is the total amount for small dots and large dots when carrying out multi-dot printing. In addition, the total amount of each type of ink is determined for all of the ink.

In step S220, the CPU 21 determines whether split printing is necessary using the ink duty which is determined in the manner described above and the duty limit which corresponds to the remaining amount of ink. Split printing is necessary if the current amount of ink discharge is not able to be supplied within the duty limit. For example, there is a high possibility that split printing is necessary if printing of a solid region is necessary in a state where the duty limit is being applied. It is reasonable that it may be determined that split printing is necessary without the amount of ink discharge which is necessary being determined in step S210 if the number of splits is simply determined based only on the duty limit as described above.

Next, in step S230, the CPU 21 determines whether or not ink which is necessary for split printing is a dark color. Determining of whether the ink is a dark color is carried out because it is irrelevant if the number of splits to an even number of splits with the light color as described above since it is barely possible for even slight positional deviations to be visible with a bright light color such as yellow. It is also possible to add light cyan or light magenta as the bright light colors. Here, it is sufficient if the bright light colors are determined by examining each color.

In step S240, the number of splits is determined in a case where the ink is a dark color. At this time, the number of splits is set to an odd number. With IkS as the amount of discharge which is the duty limit which corresponds to the remaining amount of ink and the ink duty (IkD) which is determined in step S210, the minimum value of a number of splits Nd is determined by rounding-up (IkD/IkS).

If it is assumed that IkD=50 and IkS=100, IkD/IkS=0.5, and this value is rounded up to one time and becomes the minimum value of the number of splits Nd. In this case, split printing is not necessary.

Next, if it is assumed that IkD=50 and IkS=34, IkD/IkS=1.47, and this value is rounded up to two times and becomes the minimum value of the number of splits Nd. However, it is necessary for the number of splits to be an odd number of times in a case of a dark color and the number of splits is set to three.

Next, if it is assumed that IkD=50 and IkS=15, IkD/IkS=3.33, and this value is rounded up to four times and becomes the minimum value of the number of splits Nd. However, it is necessary for the number of splits to be an odd number of times in a case of a dark color, and the number of splits is set to five. Here, the processing of step S210 to step S240 configures the split printing control means (step).

As described above, it is possible to maintain printing quality without printing only on the outward path or only on the return path in each of the regions when split printing is carried out due to the number of splits being an odd number of times in a case where split printing is necessary using the duty limit which is associated with the remaining amount of ink.

On the other hand, the CPU 21 determines the number of splits without being limited to an odd number of times in cases other than when the ink is a dark color in step S250.

In step S260, once the number of splits is determined, the CPU 21 performs split printing by dividing by the width of one band into regions depending on the number of splits. Here, printing (that is, interlace printing) where all of the nozzles 26*a* are used without splitting is performed in step S270 in a case where split printing is not necessary.

Since the processing above is processing which is carried out in band units, the CPU 21 determines whether the processing described above is complete for all of the bands in step S280 and the process described above continues while there are bands which have not been processed.

(Odd Number of Times of Split Printing)

Figure 8A:
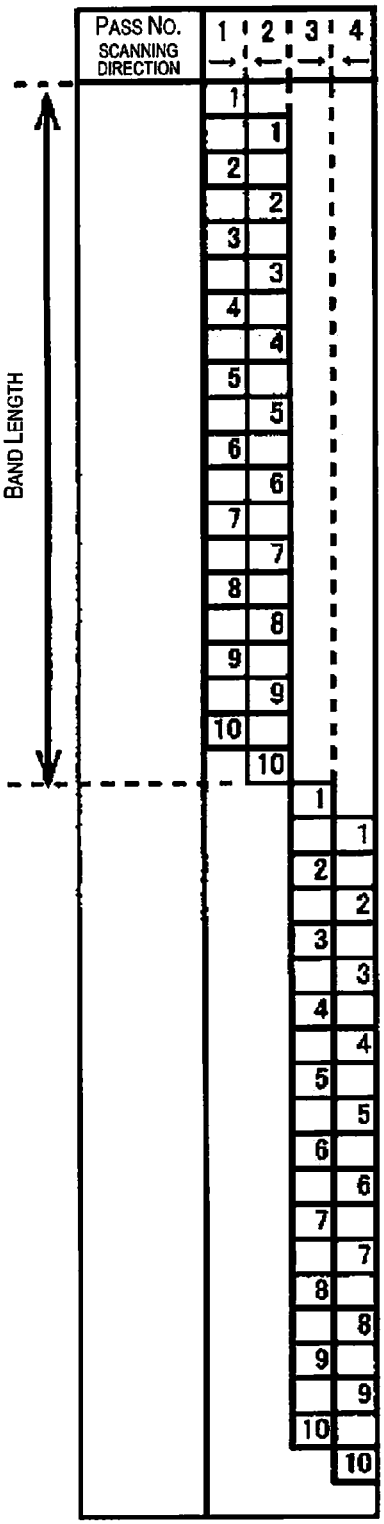
FIGS. 8A to 8C are diagrams illustrating pass division.
Figure 8B:
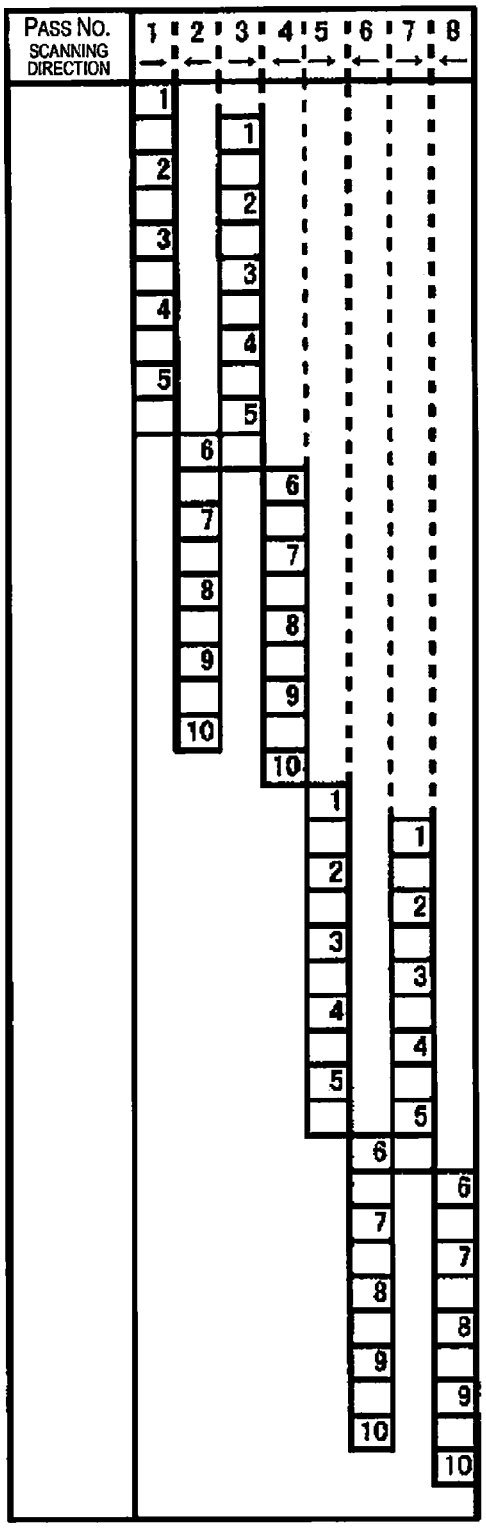
Figure 8C:
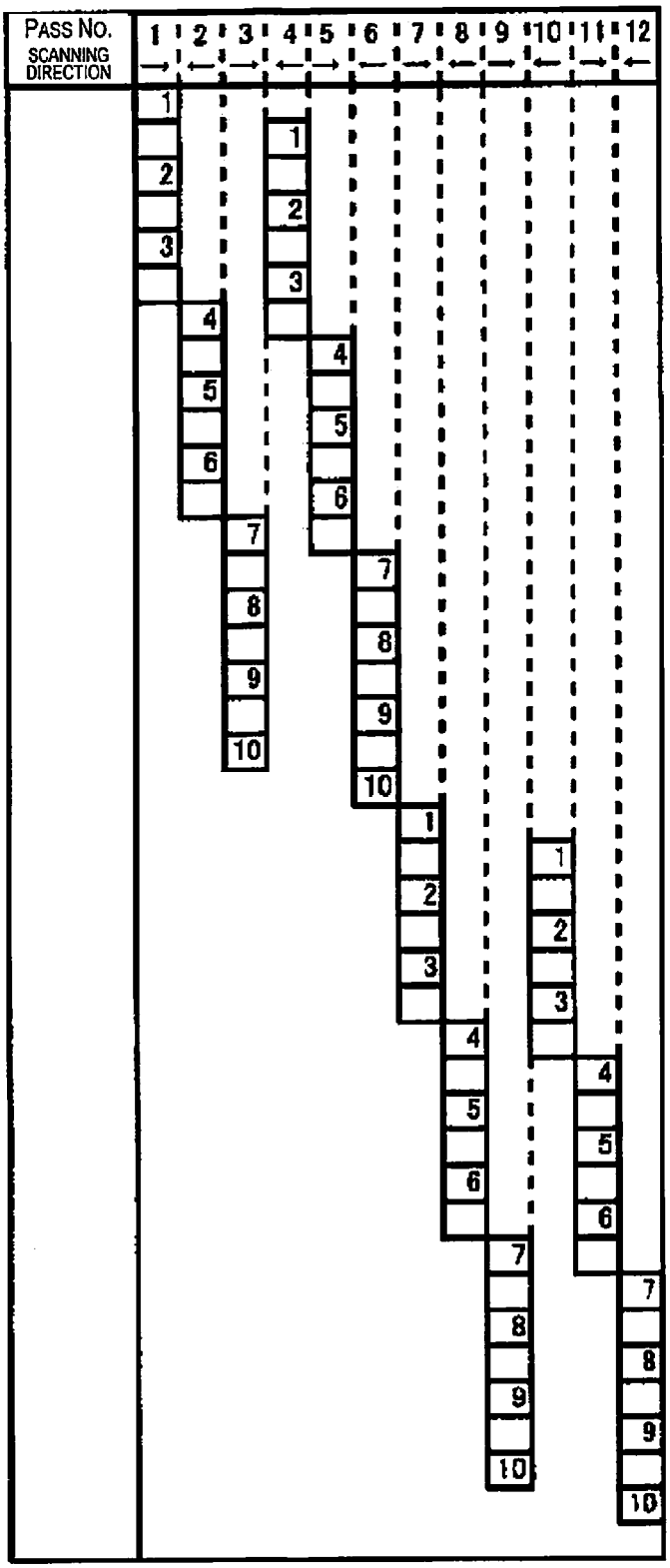

FIGS. 8A to 8C illustrate pass division using diagrams. FIGS. 8A to 8C illustrate pass division in a process where printing is performed in two bands. FIG. 8A illustrates a case where split printing is not carried out, FIG. 8B illustrates a case where the number of splits is two times, and FIG. 8C illustrates a case where the number of splits is three times. The recording head 26 repeatedly prints on the outward path, the return path, the outward path, and so on when the number of the pass is 1, 2, 3, 4, and so on.

Figure 9A:
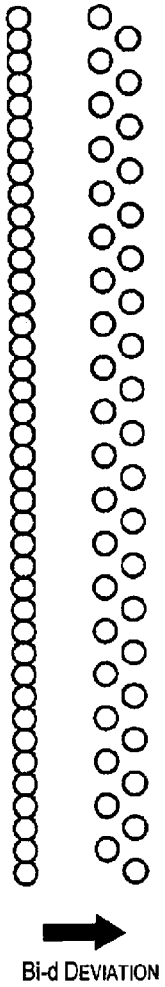
FIGS. 9A to 9C are diagrams illustrating Bi-d deviation.
Figure 9B:
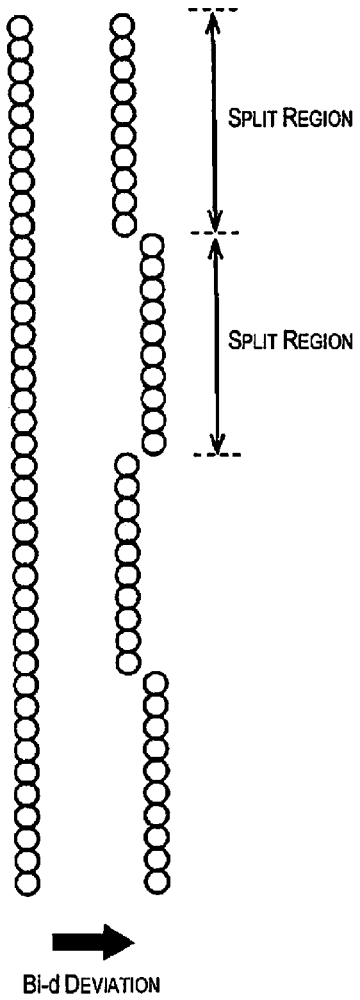
Figure 9C:
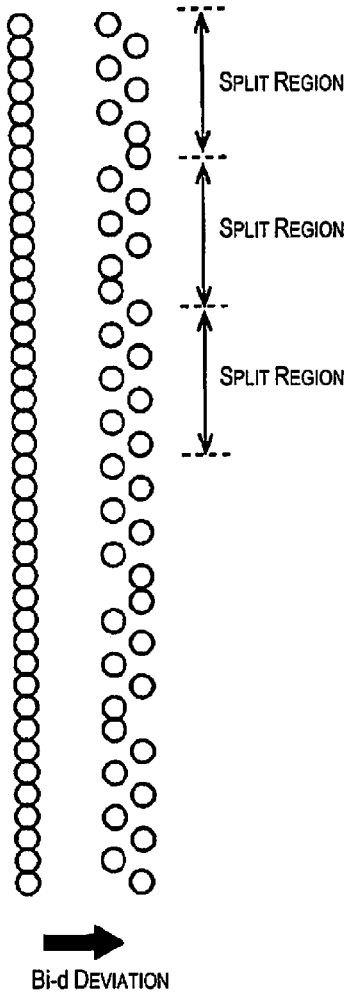

FIGS. 9A to 9C illustrate Bi-d deviation using diagrams. FIGS. 9A to 9C correspond to the pass division in FIGS. 8A to 8C. As shown in FIG. 9A, landing position deviations are generated on the outward path and on the return path as shown in the right column of FIG. 9A in a case where printing of one band is performed using one time of interlace printing. Landing position deviations are generated but it is often the case that there fortunately is an appearance of uniformity and it is not possible to for the deviations to be visible since the deviations appear in all of the regions and there is also bleeding on the printing medium. In contrast to this, landing position deviations are generated only on the outward path or only on the return path in each of the regions which are split in interlace printing where the number of splits is two times (an even number of times) as shown in the right column of FIG. 9B. In this manner, the non-uniformity is visible as a consequence even if there is bleeding on the printing medium when the landing position deviations alternately appear in each of the regions. In contrast to this, printing in all of the regions which are split is necessarily carried out on the outward path and on the return path and uniformity is apparent over all of the regions even though landing position deviations are generated in each of the regions in interlace printing where the number of splits is three times (an odd number of times) as shown in the right column of FIG. 9C. By doing this, it is often the case that there fortunately is an appearance of uniformity and it is not possible for the deviations to be visible since there is also bleeding on the printing medium in the same manner as in the case of FIG. 9A.

(Image Quality Deterioration in Acceleration and Deceleration Regions)

When the carriage is moved back and forth, there are acceleration regions and deceleration regions at both ends of the guide rail and a central portion is a region where the speed is constant. It is known that landing position deviations are generated in the acceleration regions and the deceleration regions.

Figure 10A:
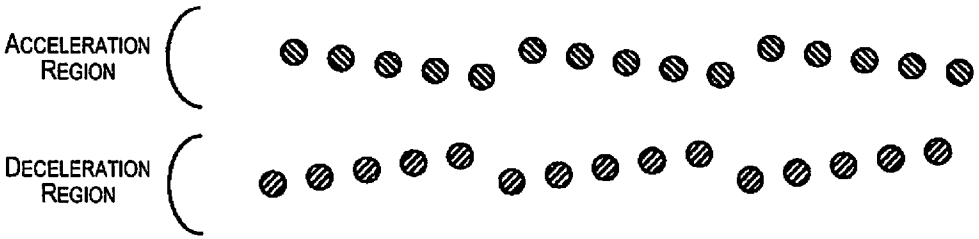
FIGS. 10A to 10C are diagrams illustrating dot adhering positions in acceleration and deceleration regions with odd number splitting and even number splitting.
Figure 10B:
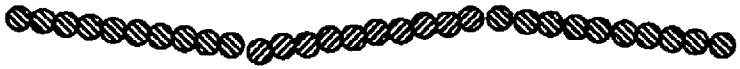
Figure 10C:
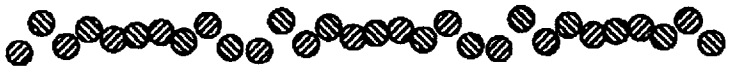

FIGS. 10A to 10C illustrate dot adhering positions in the acceleration and deceleration regions with odd number splitting and even number splitting using diagrams. FIG. 10A illustrates positional deviations in the acceleration region and the deceleration region, FIG. 10B illustrates a case where there is an even number of splits, and FIG. 10C illustrates a case where there is an odd number of splits. In a case where split printing is carried out, a region, where printing is carried out in one pass, is reduced in theory. However, five dots are respectively drawn in all cases in FIGS. 10A to 10C so as to be equivalent to printing one pass in order for the tendency for image deterioration in the acceleration and deceleration regions to be easy to understand.

In interlace printing, it is difficult for image deterioration to stand out in the acceleration and deceleration regions in a case where split printing is not carried out since the dots which are printed in the deceleration regions are interposed between the dots which are printed in the acceleration region. The same effects occur in the case of Bi-d printing.

However, image deterioration stands out when split printing is carried out in a case where an even number of splits is carried out since the dots which are printed in the acceleration regions are interposed between the dots which are printed in the acceleration regions and the dots which are printed in the deceleration regions are interposed between the dots which are printed in the deceleration regions and this is repeated in every region in FIG. 10B. However, it is difficult for image deterioration to stand out when split printing is carried out in a case where an odd number of splits is carried out since the dots which are printed in the deceleration regions are interposed between the dots which are printed in the acceleration regions in FIG. 10C in the same manner as the case where split printing is not carried out.

It is possible to take precautions even against image deterioration in the acceleration and deceleration regions since an odd number of splits is performed automatically due to the printing control process shown in FIG. 7 being performed.

(Split Printing Using Limit on Power Consumption)

In the applied example described above, split printing is carried out due to a cause of a limit on the dischargeable amount per unit of time due to the properties of the ink cartridge 26*f*. However, there are also cases where split printing is necessary due to other reasons.

A limit on power consumption is one example of such a reason. Power consumption is related to the number of nozzles since it is necessary to supply power to each of the nozzles 26*a* in discharging of ink droplets. It is possible to reduce the number of the nozzles 26*a* which are used and to reduce power consumption by carrying out split printing in a case where the limit on power consumption is exceeded when all of the nozzles 26*a* are used in one band.

A predetermined region in one band is split an odd number of times according to the limit on power consumption and interlace printing is carried out in each of the split regions on the outward path and the return path in a case where there is demand for the limit on power consumption. It is possible to solve the problem in the same manner by splitting a predetermined region in one band an odd number of times according to the limit on power consumption and carrying out interlace printing in each of the split regions on the outward path and the return path since the problem, which is generated by split printing even though the reason is different, is exactly the same.

(Split Printing Using Limit on Ink Duty for Printing Medium)

There are cases where split printing is effective even if there is no reason on the recording head 26 side.

An amount of ink which is able to be adsorbed per unit of time per unit area and the limit on ink duty are known to depend on the printing medium. When a large amount of liquid is absorbed in short period of time, the printing medium warps, there is color mixing before the inks are fixed on the printing medium, and the coloring which is intended is not obtained. Although the extent of this differs according to the printing medium, it is necessary to print without exceeding the limit on ink duty (the maximum value of the amount of ink which it is able to be adsorbed per unit of time per unit area in order for there are none of the adverse effects described above) which is associated with the printing medium which is specified at the printer 20 side during printing.

However, it is possible that there are cases where the limit on ink duty is exceeded when accurately following raster data which is supplied to the printer 20. In this case, split printing is effective. It is possible to secure a period of time for drying due to the time difference from the amount of discharge which is to be theoretically printed in one pass being discharged onto the printing medium by carrying out split printing and splitting in two passes or three passes. It is possible to mitigate the limit on the amount of discharge per unit of time since the printing time is longer for two pass printing than one pass printing and is even longer for three pass printing.

When carrying out split printing, it is possible to solve the problem in the same manner by carrying out an odd number of splits since the problem which is generated by split printing is exactly the same even though the reason is different.

That is, it is possible to take precautions against the problems described above by splitting the predetermined region in one band an odd number of times according to the limit on ink duty for the printing medium and carrying out interlace printing in each of the split regions on the outward path and the return path.

Here, it is obvious that the present invention is not limited to the applied examples. It would be obvious to a person skilled in the art that:

applying appropriate modifications to the combinations of members, configurations, and the like which are disclosed in the applied examples and which are able to be mutually interchanged, applying appropriate interchanging and modifications to the combinations of members, configurations, and the like which are able to be mutually interchanged with members, configurations, and the like, which are known techniques and which are disclosed in the applied examples even though these are not disclosed in the applied examples, applying appropriate interchanging and modifications to the combinations of members, configurations, and the like which are able to be assumed as substitutes for members, configurations, and the like which are disclosed in the applied examples to a person skilled in the art based on known techniques and the like even though these are not disclosed in the applied examples, are disclosed as applied example of the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A printing control apparatus configured to use a recording head where a plurality of nozzles are arranged in a row formation with a predetermined pitch, and configured to perform interlace printing on an outward path and a return path such that a resolution is equal to or more than a resolution that is based on the pitch when printing is performed due to supplying of ink being received from an ink cartridge and ink droplets being discharged from each of the nozzles, the printing control apparatus comprising:

a dischargeable amount acquiring section configured to determine a dischargeable amount per one pass according to a remaining amount of ink in the ink cartridge; and a split printing control section configured to split a predetermined region in one band an odd number of times according to the dischargeable amount per one pass by splitting the plurality of nozzles into an odd number of groups of nozzles with each group of nozzles including adjacent nozzles, and configured to carry out interlace printing in each of split regions on the outward path and the return path.

2. The printing control apparatus according to claim 1, wherein the split printing control section is configured to determine a number of splits according to the remaining amount of ink in the ink cartridge.

3. The printing control apparatus according to claim 1, wherein the split printing control section is configured to split the predetermined region in one band the odd number of times according to a limit on power consumption, and is configured to carry out the interlace printing in each of the split regions on the outward path and the return path.

4. The printing control apparatus according to claim 1, wherein the split printing control section is configured to split the predetermined region in one band the odd number of times according to a limit on ink duty for a printing medium, and is configured to carry out the interlace printing in each of the split regions on the outward path and the return path.

5. The printing control apparatus according to claim 1, wherein the split printing control section is configured not to limit a number of times of splitting to the odd number of times in a case where ink of a target for printing is only a color with a predetermined brightness.

6. A printing control method for using a recording head where a plurality of nozzles are arranged in a row formation with a predetermined pitch, and for performing interlace printing on an outward path and a return path such that a resolution is equal to or more than a resolution that is based on the pitch when printing is performed due to supplying of ink being received from an ink cartridge and ink droplets being discharged from each of the nozzles, the method comprising:

determining a dischargeable amount per one pass according to a remaining amount of ink in the ink cartridge; and splitting a predetermined region in one band an odd number of times according to the dischargeable amount per one pass by splitting the plurality of nozzles into an odd number of groups of nozzles with each group of nozzles including adjacent nozzles, and carrying out interlace printing in each of split regions on the outward path and the return path.

7. The printing control apparatus according to claim 1, wherein the dischargeable amount acquiring section is further configured to determine the dischargeable amount per one pass according to the remaining amount of ink in the ink cartridge based on a predetermined correspondence relationship between the dischargeable amount and the remaining amount of ink.

8. The printing control method according to claim 6, wherein the determining is performed by determining the dischargeable amount per one pass according to the remaining amount of ink in the ink cartridge based on a predetermined correspondence relationship between the dischargeable amount and the remaining amount of ink.

* * * * *